US007373905B2

(12) United States Patent
Fuchs et al.

(10) Patent No.: US 7,373,905 B2
(45) Date of Patent: May 20, 2008

(54) DIESEL AIRCRAFT ENGINE

(75) Inventors: Michael J. Fuchs, New Richmond, WI (US); Steven M. Weinzierl, New Richmond, WI (US)

(73) Assignee: Schrick, Inc., Osceola, WI (US)

( * ) Notice: Subject to any disclaimer, the term of this patent is extended or adjusted under 35 U.S.C. 154(b) by 0 days.

(21) Appl. No.: 11/687,325

(22) Filed: Mar. 16, 2007

(65) Prior Publication Data

US 2007/0209616 A1 Sep. 13, 2007

Related U.S. Application Data

(63) Continuation of application No. 11/072,624, filed on Mar. 4, 2005, now Pat. No. 7,191,742.

(60) Provisional application No. 60/642,837, filed on Jan. 11, 2005.

(51) Int. Cl.
*F02B 75/22* (2006.01)
*F02B 75/06* (2006.01)

(52) U.S. Cl. ..... 123/55.2; 123/55.5; 74/603

(58) Field of Classification Search ..... 123/55.2, 123/55.4–55.7, 192.2; 74/603, 604
See application file for complete search history.

(56) References Cited

U.S. PATENT DOCUMENTS

| | | | |
|---|---|---|---|
| 1,405,093 | A | 1/1922 | Beecher |
| 2,076,892 | A | 4/1937 | Irgens |
| 2,287,224 | A | 6/1942 | Barkeij |
| 3,027,706 | A | 4/1962 | Sprick |
| 4,632,072 | A | 12/1986 | Brogdon |
| 4,966,042 | A | 10/1990 | Brown |
| 5,052,354 | A | 10/1991 | Kindaichi |
| 2001/0029919 | A1 | 10/2001 | Cagney et al. |

FOREIGN PATENT DOCUMENTS

| | | |
|---|---|---|
| DE | 3417349 | 11/1985 |

*Primary Examiner*—Noah P. Kamen
(74) *Attorney, Agent, or Firm*—Carlson, Gaskey & Olds

(57) ABSTRACT

The present invention is an engine, including two banks of cylinders in a flat, opposed cylinder arrangement and a crankshaft having a plurality of paired throws, the two throws of each respective pair of throws being disposed adjacent to each other and coplanar with respect to each other.

11 Claims, 16 Drawing Sheets

DIESEL AIRCRAFT ENGINE

RELATED APPLICATION

This application is a continuation of U.S. patent application Ser. No. 11/072,624, filed on Mar. 4, 2005, now U.S. Pat. No. 7,191,742, which claims benefits of U.S. Provisional Application No. 60/642,837, filed Jan. 11, 2005.

FIELD OF THE INVENTION

The present invention relates to a multi-cylinder engine for use in light weight, high specific power applications. More particularly, the present invention is a horizontally-opposed eight cylinder diesel engine for use in aircraft.

BACKGROUND OF THE INVENTION

Horizontally opposed, piston-driven engines are known in the art, and widely used in the aviation industry. However, there is a need in the industry to provide an engine that does not rely on fuel containing tetraethyl lead, a component currently contained in aviation gasoline. There is a further need for an engine offering high specific power output in a light weight package.

In the past, there was a tremendous amount of effort to increase the specific power of engines. In particular, the efforts were focused at delivering light-weight, high-power, piston engines for use in military fighter and bomber airplanes. The direction generally taken by both the Allied and Axis powers was to rely heavily on two particular strategies. The first was to develop air-cooled radial engines. These engines were designed with the shortest crankshaft available (single-throw, master-slave rod), and were arranged to make the best use of the frontal area to effectively cool the vital engine components, as shown in FIGS. 1 and 2.

Another strategy employed was to use the Vee (or "V") configuration to reduce weight by minimizing the crankshaft length. A reduction in crankshaft length consequently reduces the engine volume and weight of the engine. Length was so important, that in extreme cases the fork-and-knife method was used to minimize engine cylinder bank offset, and further reduce weight, as shown in FIG. 4. The engines were generally smaller in displacement than the air-cooled counterparts, and were comprised of ideally-balanced inline configurations sharing a common crankshaft. For this reason, the dominant liquid-cooled engine was a V-12 because it was made up of two perfectly balanced six cylinder engines. FIG. 3 is an example of a V-12 engine. The V-12 also had a certain level of redundancy with the ability to pair ancillaries etc.

In the past years Schrick (assignee of the present application) has made some monumental advances with regards to utilizing diesel engines in aero applications. One such engine was the air-cooled Hurricane engine as shown in FIG. 5, which used strategies similar to the large radial, gasoline powered engines in the Second World War. This twin cylinder diesel engine was air-cooled, and shared many of the basic design elements of the Second World War engines with advances in materials and processing applied. The engine was remarkable in that it achieved an installed weight of 1.15 lbs/hp in the 600 cc displacement class for a diesel engine.

Accordingly, there is a need for a more production feasible solution for the General Aviation (hereinafter "GA") community. Current GA engines have their roots in the air-cooled engines of the Second World War era. They are identical in many respects, with the exception of being horizontally-opposed engines. This engine configuration has been used in the past by Volkswagen and Porsche, as well as the dominant aero engine manufacturers Lycoming and Continental. FIG. 6 is a depiction of this engine type.

Although the engine configuration of FIG. 6 is not ideal from a weight perspective, it does provide the cooling air space necessary for the air-cooled cylinder heads. It also allows for a more streamlined package within the confines of an aircraft installation. However, the horizontally opposed engine is unnecessarily long, due to the nature of its crankshaft layout. In this configuration, each throw of the crankshaft is used for a single cylinder.

There is a further need in the industry for an engine that does not rely on tetraethyl-based lead. Lead additive is currently vital to aviation fuel for its anti-knock properties, however it is very harmful to the environment and only produced today in limited quantities.

SUMMARY OF THE INVENTION

The present invention substantially meets the aforementioned needs of the industry.

The use of a "paired-throw" configuration according to the present invention reduced the first order vibration moment by about 300%. A reduction of this magnitude allowed the use of a relatively light-weight first order moment balance shaft. This device effectively eliminates all of the first order rocking couple.

It should be mentioned here that although the example shown here is for an eight cylinder engine. The identical strategy can be used for 6, 10, and 12 cylinder engines. This technique is useful for aircraft and other engines where compactness and power density is a primary objective. It is contemplated that the present invention would also be useful in military vehicles and boats alike. In military vehicles, the engine could be placed very low in the vehicle, offering blast protection to the operators, sitting above the engine and further offering a low center of gravity for increased stability.

In a diesel engine, as in most engines, there are several circuits which must be cooled to ensure internal component reliability, such as the normal engine and oil coolers. The turbocharged diesel engine requires an additional charge-air cooler (or intercooler) to achieve maximum performance. The function of this cooler is to increase charge density and thus air mass flow through the engine.

In this particular engine design, the cooling requirements of the liquid elements of the engine are accomplished by an engine-mounted radiator. The oil is cooled by a water/oil element that ensures proper pre-warning of the oil in cold climates. Mounting on the engine is facilitated by the flat-vee configuration. It also allows the engine to be installed in traditional aircraft cowls without significant additional design work on the part of the aircraft company.

The flat-vee allows the entire width of the engine bay to be pressurized and sealed to the twin cooler matrices. This minimizes resultant aircraft drag, which has a large effect on aircraft speed and fuel economy.

By not having to remote mount the glycol and water systems, the entire engine installation remains lightweight. This is primarily due to the fact that water and oil lines are heavy, and do little to decrease the heat of the contained liquids. Also, this gives a universal cooling strategy which can be used on all air-cooled aircraft designs. Hence, the design makes it easy for the manufacturer to make a retrofit of the present engine assembly in existing aircraft.

Air-air charge air coolers share the pressure cowl with the engine cooler element. The two are in close proximity, and this feature allows for very compact packaging within constraints of the cowling. The charge air cooler installation provides for a unified engine cooling strategy.

The present invention is an engine, including two banks of cylinders in a flat, opposed cylinder arrangement and a crankshaft having a plurality of paired throws, the two throws of each respective pair of throws being disposed adjacent to each other and coplanar with respect to each other.

DETAILED DESCRIPTION OF THE DRAWINGS

Figure 1:
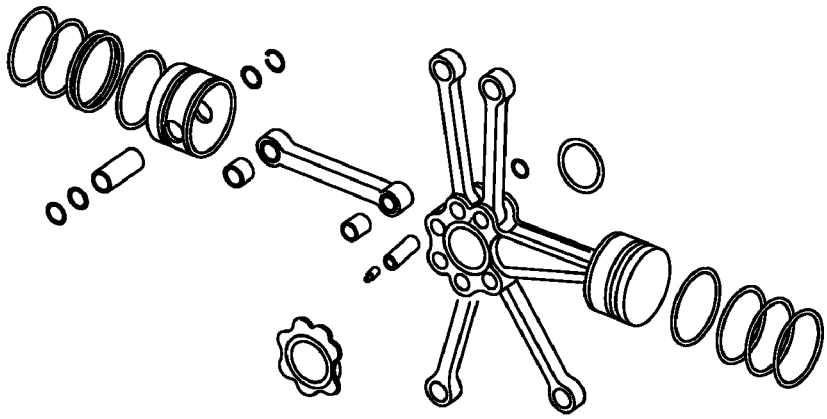
FIG.1 Prior Art
FIG. 1 is an exploded view of a prior art crankshaft arrangement for use in a radial aircraft engine.
Figure 2:
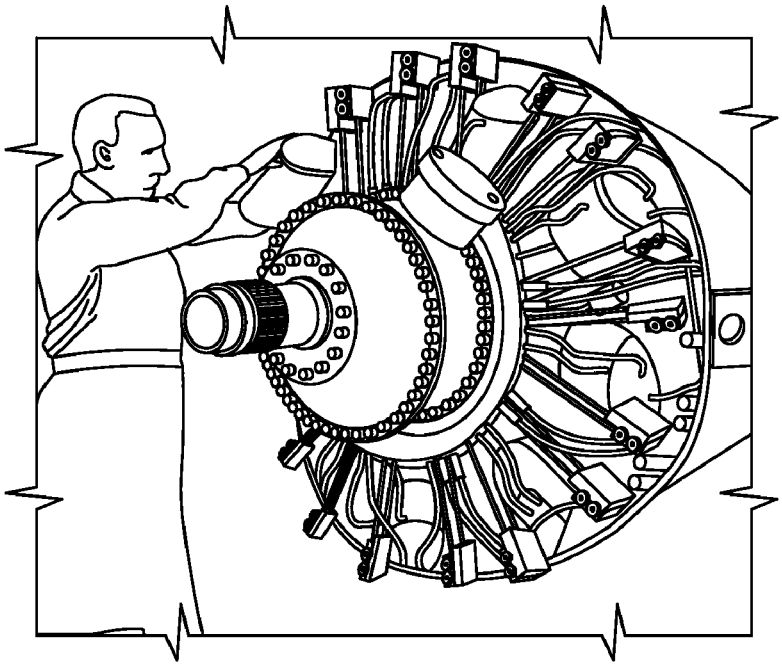
FIG.2 Prior Art
FIG. 2 is a perspective view of a prior art air-cooled radial aircraft engine.
Figure 3:
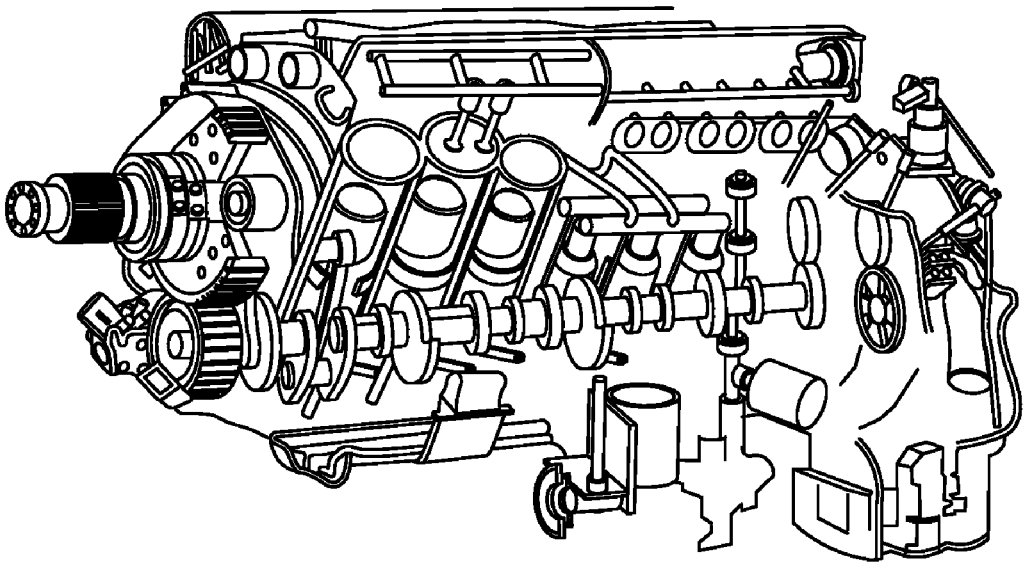
FIG.3 Prior Art
FIG. 3 is a partial cutaway view of a prior art liquid-cooled V-12 aircraft engine.
Figure 4:
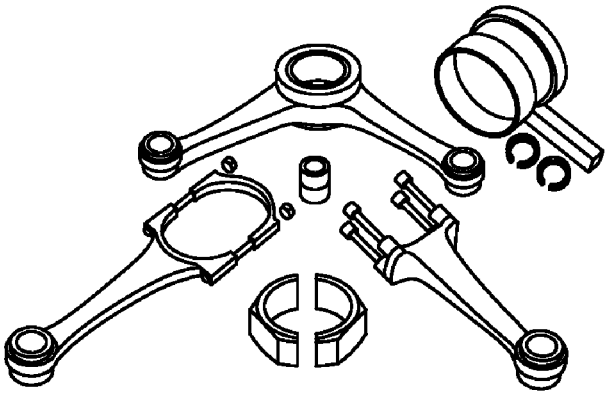
FIG.4 Prior Art
FIG. 4 is a perspective view of a prior art fork-and-knife connecting rod arrangement.
Figure 5:
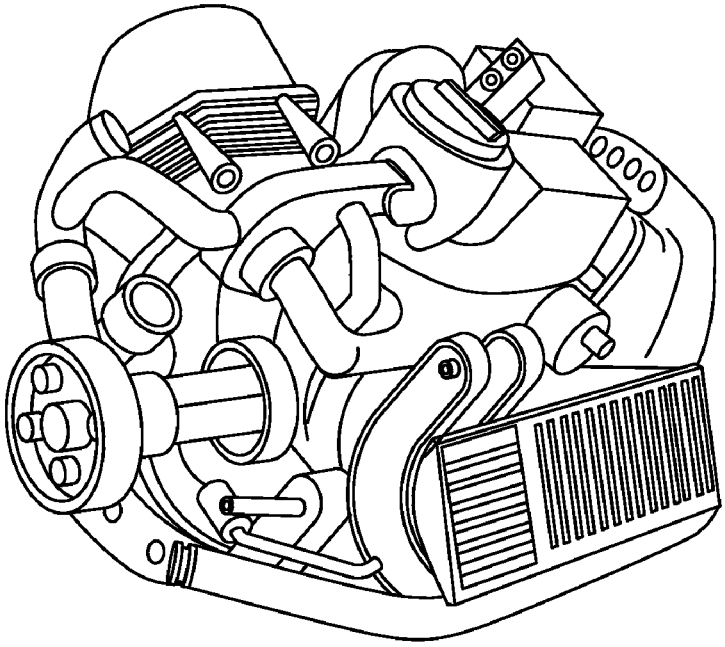
FIG.5 Prior Art
FIG. 5 is a perspective view of a prior art air-cooled diesel aircraft engine.
Figure 6:
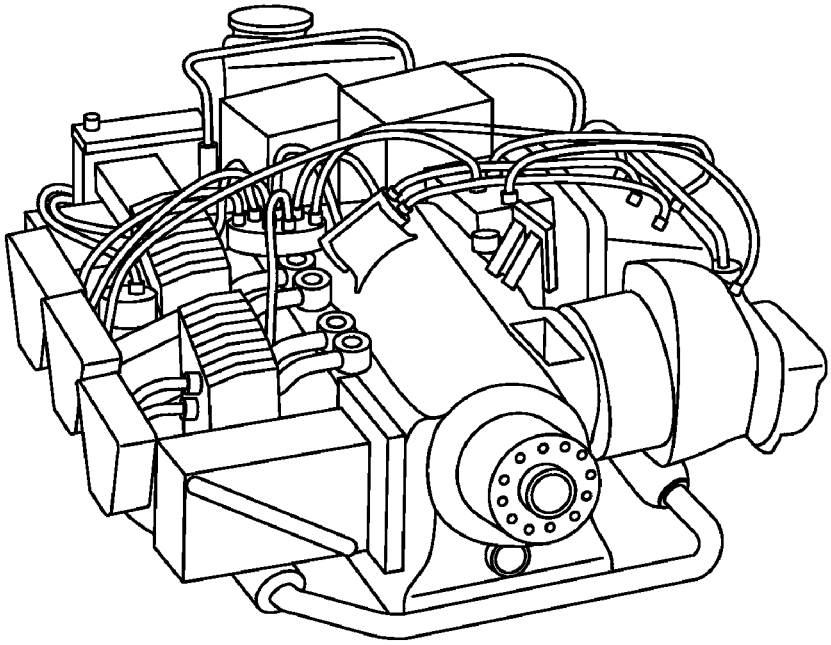
FIG.6 Prior Art
FIG. 6 is a perspective view of a prior art air-cooled horizontally opposed air-cooled six cylinder aircraft engine.
Figure 7:
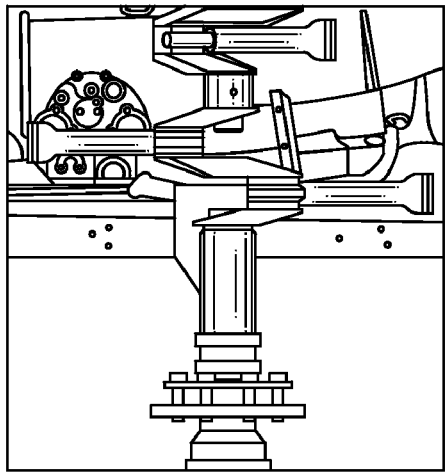
FIG.7 Prior Art
FIG. 7 is a side view of a prior art crankshaft used in horizontally opposed air-cooled six cylinder aircraft engine.
Figure 8:
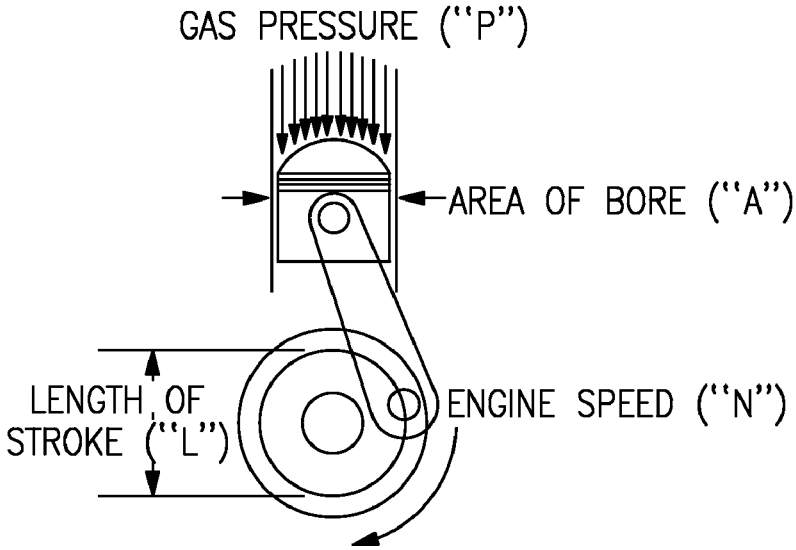
FIG.8 Prior Art
FIG. 8 is a prior art schematic representation of an internal combustion engine.

Any piston engine is simply a collection of pressure vessels that utilizes a crank rocker (crankshaft) mechanism to impart the expansion work of gases for the purpose of delivering useful work, as shown in FIG. 8. The challenge to engine designers has always been to develop an elegant structure that uses no more material than necessary to deliver reliable power. With recent advances in diesel technology, the necessity to optimize engine block and crank shaft design has become evident. Modem diesel engine combustion creates gas forces in the area of 200 bar peak pressure. This is more than twice the pressure of a typical gasoline automotive engine. The two most massive engine components by weight have traditionally been the engine block and crankshaft assembly.

Although it is well known by engineers that modem diesel engines are more thermally efficient, the challenge has been to integrate diesels into a compact weight-efficient package. Nowhere is this more critical than in the design of aero applications. This application demands that an engine be lightweight, durable, efficient, and powerful. To achieve these characteristics simultaneously, the engineer must go through a thorough "sizing" study to determine how much engine capacity is sufficient to do the job properly.

BMEP, or "P" in the equation below, is used to compare the performance of various engine configurations. It is the average pressure over the cycle time that an engine would achieve if it were operating as a constant pressure device. The basic equation for engine power can be simplified to the following form:

$$\text{Power}=P\times L\times A\times N$$

Where:

P=Average pressure on the piston;

L=Stroke length;

A=Piston area;

N=Firing pulses per minute.

Power, therefore, is a function of BMEP, engine geometry, and engine speed. It should be evident then that given the same power target, the options are limited for the engine designer. It should also be evident that the only way to increase power output of a four-stroke engine is to:

1. Increase capacity (engine displacement by increasing a combination of L & A);
2. Increase engine speed (firing pulses per unit time);
3. Increase P (the average pressure over the cycle).

Since the goal is to obtain more specific power, the task of the engine designer is to increase power without a corresponding increase in weight. The significance of this is that by definition, an increase in engine volume will result in an increase in weight. This effectively eliminates option "1" above.

To increase engine speed would certainly result in an increase in specific power. However, this is generally contradictory to engine durability. Things like bearing loading, piston speed, and dynamic vibrations are generally increased with engine speed. A gear reduction can be used to provide torque amplification when the torque capacity of an engine is insufficient. This is not without penalty, as the designer must consider the tradeoff between engine displacement, and gear reduction weight. Another consideration is the gear efficiency (sound characteristic) and torsional behavior of such a gear reduction.

An additional element to consider with regard to increasing engine speed is that the dimensional accuracy of the engine machined components must be increased to ensure proper dynamic engine behavior. This fact translates directly to increased manufacturing costs which certainly must be taken into consideration in the construction of a lightweight, high-speed engine.

The most basic choice that an engine designer faces must deal with an engine's function within the environment that it operates. The driving force behind this particular exercise was to derive a replacement for the current GA engines in widespread use. Today, virtually all of the engines are of the horizontally opposed, air-cooled, configuration. From a packaging perspective, most of the aircraft in production, and all aircraft in service are designed around this configuration. This configuration fits well within the slipstream of a two person-wide aircraft. It can be enclosed to cool the engine within the frontal area of the fuselage.

Figure 9:
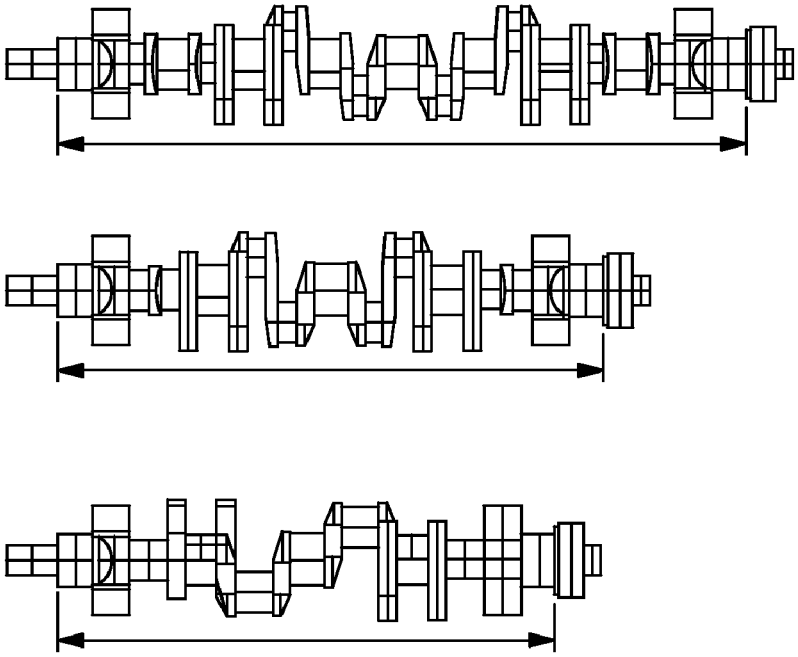
FIG.9 Prior Art
FIG. 9 is a side view of three prior art crankshafts.
Figure 10:
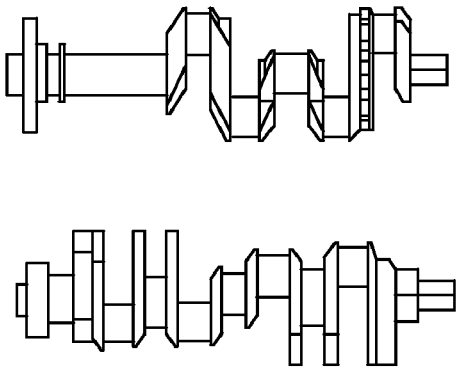
FIG.10 Prior Art
FIG. 10 is a side view of two prior art crankshafts.

The current GA engines tend to be very long, to allow proper air cooling of the cylinder heads. By using the Vee configuration, the engine designer can effectively shorten the engine, while maintaining the same frontal profile. FIG. 9 depicts a crankshaft for a common six cylinder GA engine on top, and on bottom is seen a V-8 "shared pin crankshaft" to shorten engine length. Although this technique is well known to automotive engine designers, it has not been used in GA applications. FIG. 10 further demonstrates the effectiveness of this engine design strategy, depicting a crankshaft from a four cylinder GA engine on top, and a crankshaft from an automotive diesel V-8 on bottom.

Figure 12:
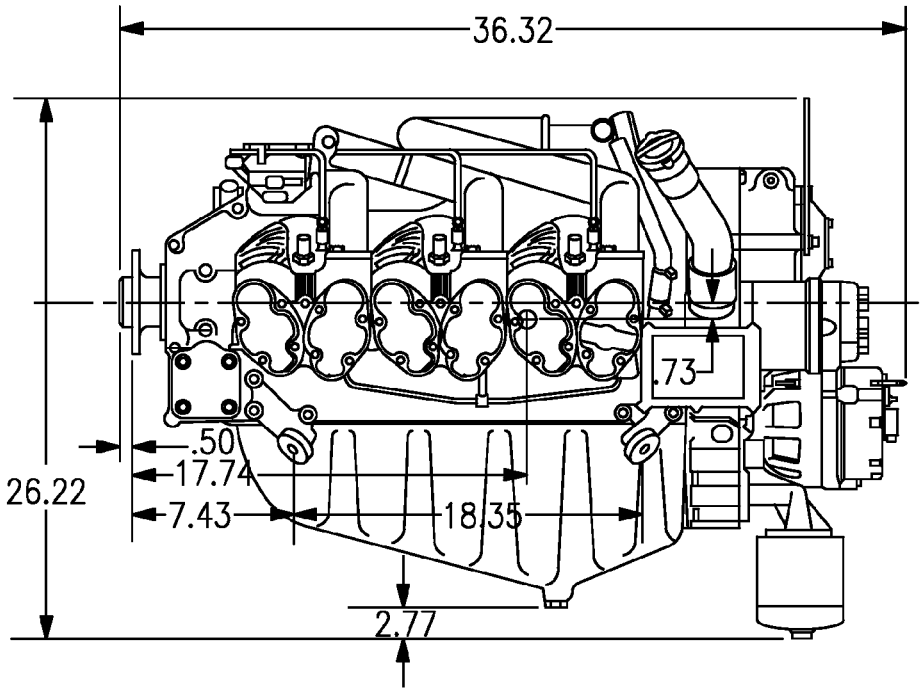
FIG.12 Prior Art
FIG. 12 is a side view of a prior art horizontally opposed air-cooled six cylinder aircraft engine.
Figure 13:
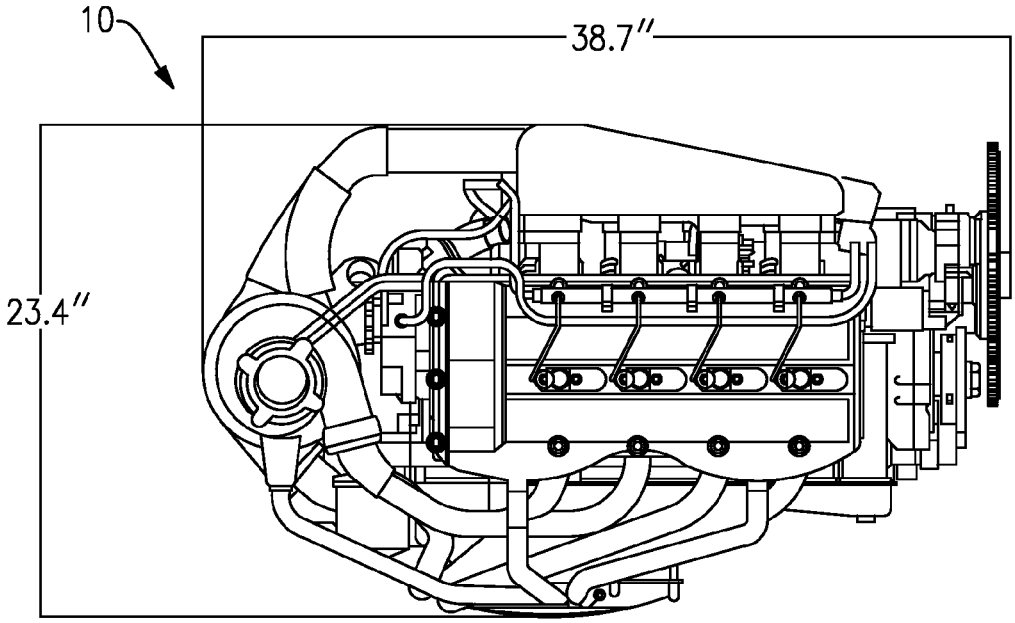
FIG. 13 is a side view of an embodiment of the present invention.

This technique allows the liquid-cooled diesel engine 10 of the present invention with increased cylinder count to be packaged within the current length constraints of the GA package. FIG. 12 is a side view of a common six cylinder GA engine, and FIG. 13 is a side view of an eight cylinder embodiment of the present invention, showing the advantage in length of using a shared pin crankshaft.

In addition to providing for an optimal installation, and package density, it was quite valuable from a design objective with engine 10 to be able to utilize "production" Vee-engine components in the prototyping phase of the engine development process of the present invention. For example, the complete cylinder head of a European passenger car could be used in the flat vee concept without modification. Other components are also useful, and this dramatically reduces the amount of development time and cost for this particular application. Components that could be "carried over" from the automotive V-8 were:

- Cylinder head with cooling passages
- Combustion system; intake and exhaust ports, piston bowl geometry, injector configuration
- Cylinder head gaskets
- Connecting rods
- Pistons
- Main bearing sizing
- Cam drive mechanism
- Cam chain tensioner elements
- High-pressure fuel rail
- High pressure fuel pump Although the engine package is important, achieving proper engine balance is probably more important to the service life of the engine, and its ancillary systems. By nature, aircraft structures tend to be very lightweight, and are greatly affected by the vibration signature of the engine.

Figure 11:
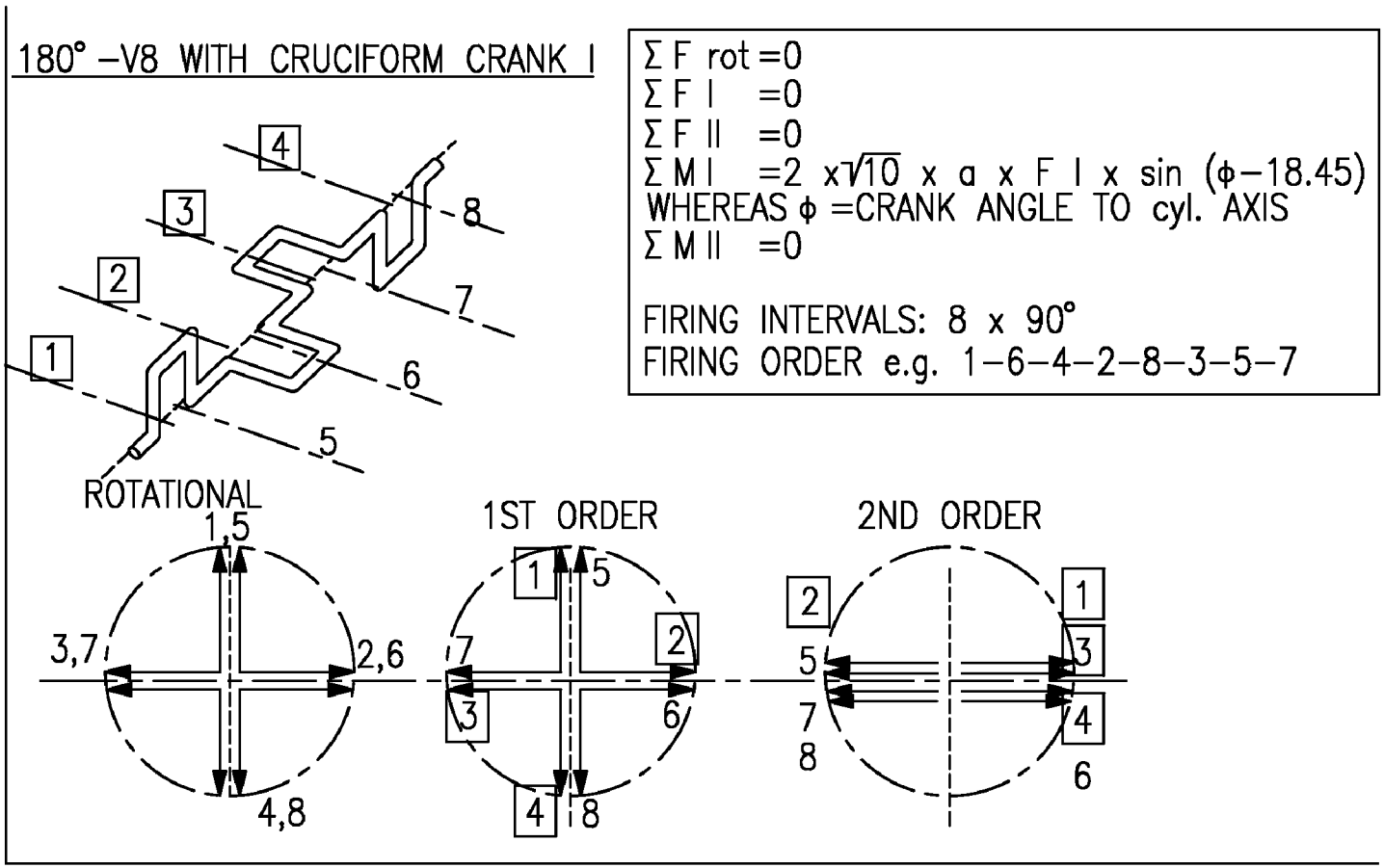
FIG.11 Prior Art
FIG. 11 is a diagram showing the moments of vibration of a prior art crankshaft.

To determine if the 180-degree engine had merit as a solution, the use of a usual "cruciform" crank as shown in FIG. 11 was first studied. This is the crankshaft that is widely used in the traditional American V-8. It is usefull for dramatically reducing vibrations in the automotive application (90-degree V-8), and fits within the environment of the automotive package. The engine is normally installed longitudinally, and the 90-degree vee allows clearance for the front suspension, and provides an unobstructed path for the vehicle exhaust system.

When the Vee angle is "flattened" to 180-degrees, the first order vibration moment is doubled, rendering the engine unserviceable from a vibration perspective. It was realized that although this situation could be corrected with a balance shaft turning at crank speed, the mass of the balance weights would make the engine unnecessarily heavy.

Figure 14:
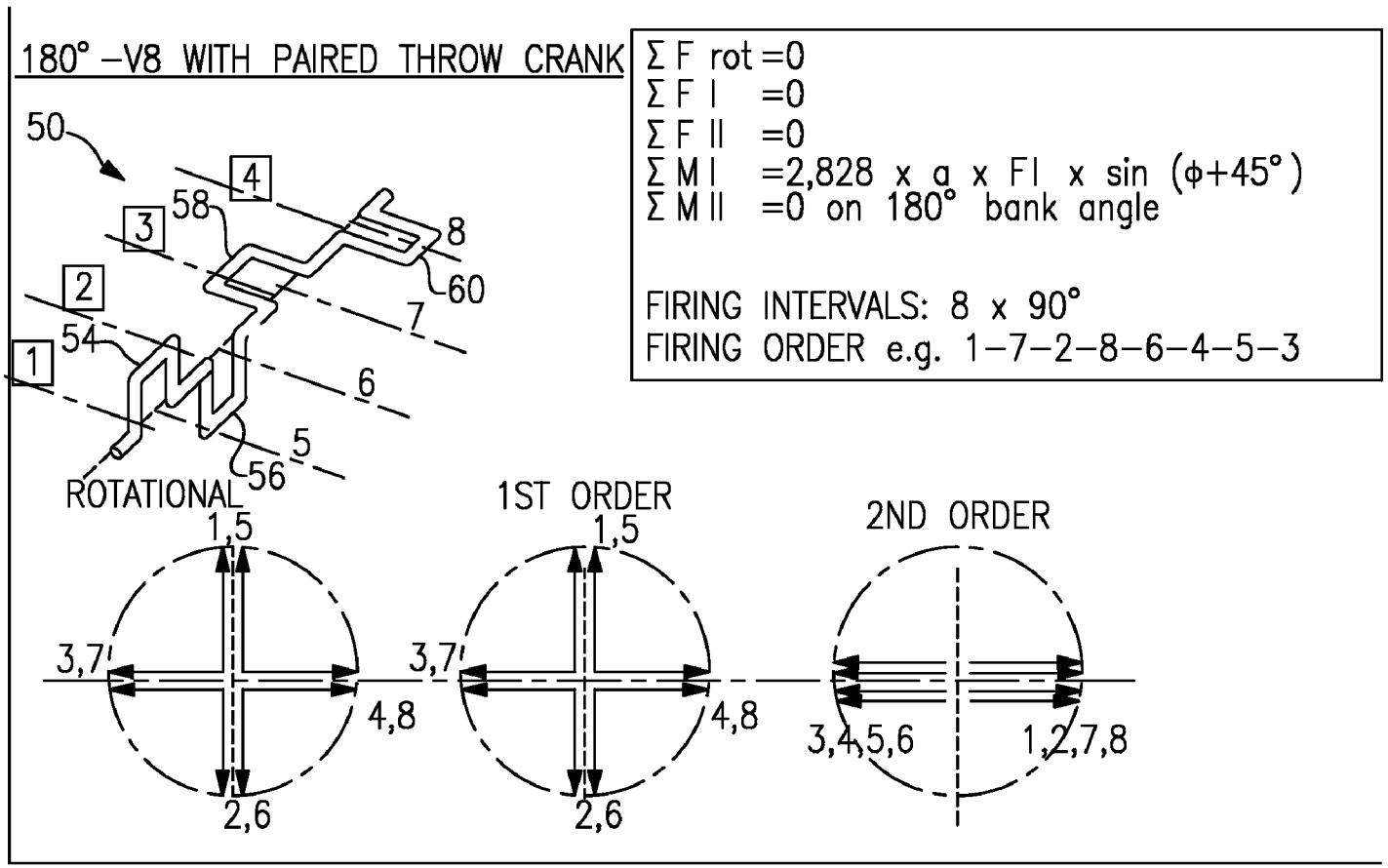
FIG. 14 is a diagram showing the moments of vibration of a crankshaft according to the present invention.
Figure 17:
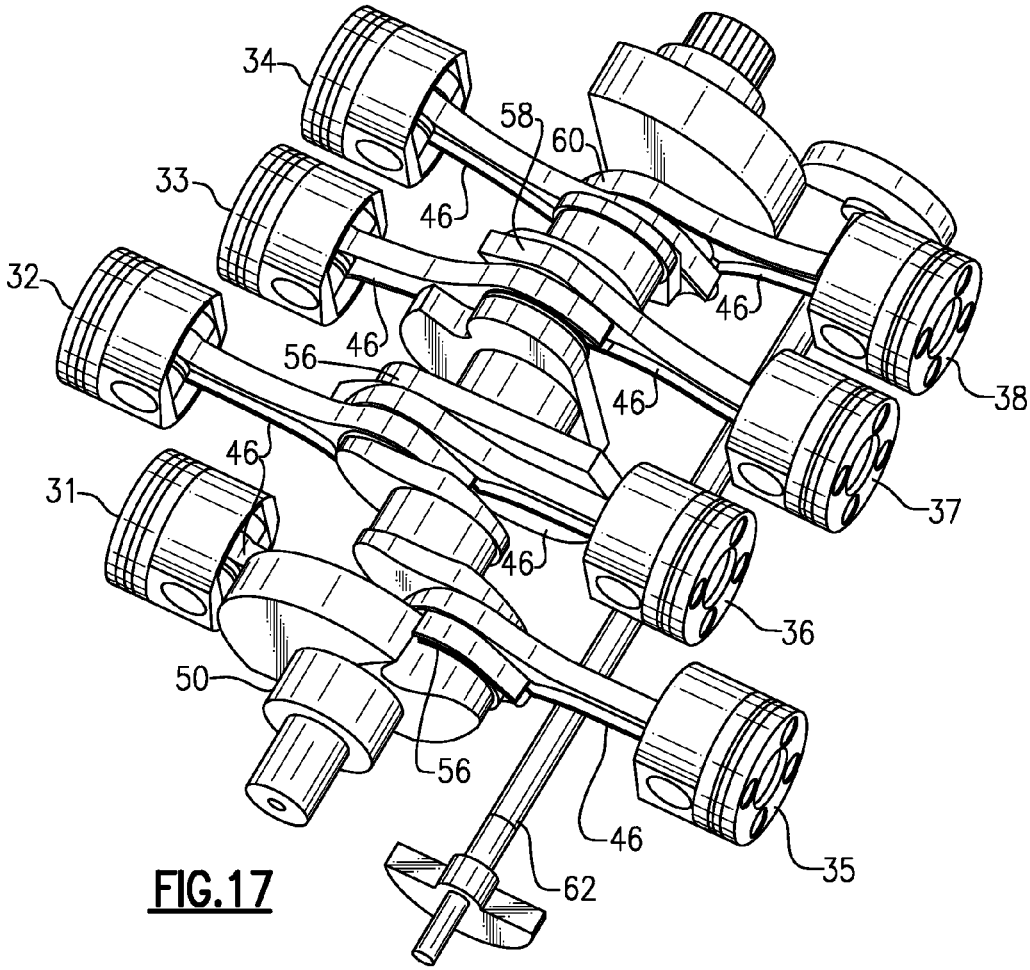
FIG. 17 is a perspective view of an assembled crankshaft according to the present invention.

However, the use of a "paired-throw" configuration of the crankshaft 50 according to the present invention reduced the first order vibration moment by about 300%, as shown schematically in FIG. 14. A reduction of this magnitude allowed the use of a relatively light-weight first order moment balance shaft, as shown in FIG. 17. This device effectively eliminates all of the first order rocking couple.

The engine 10 of the present invention is shown generally in FIGS. 13, 14, 28, and 29. Engine 10 has major components engine block 12, cylinder heads 14 and 16, injection system 18, cooling system 20, intake system 22, exhaust system 23, oiling system 24 and crankshaft 50.

Figure 15:
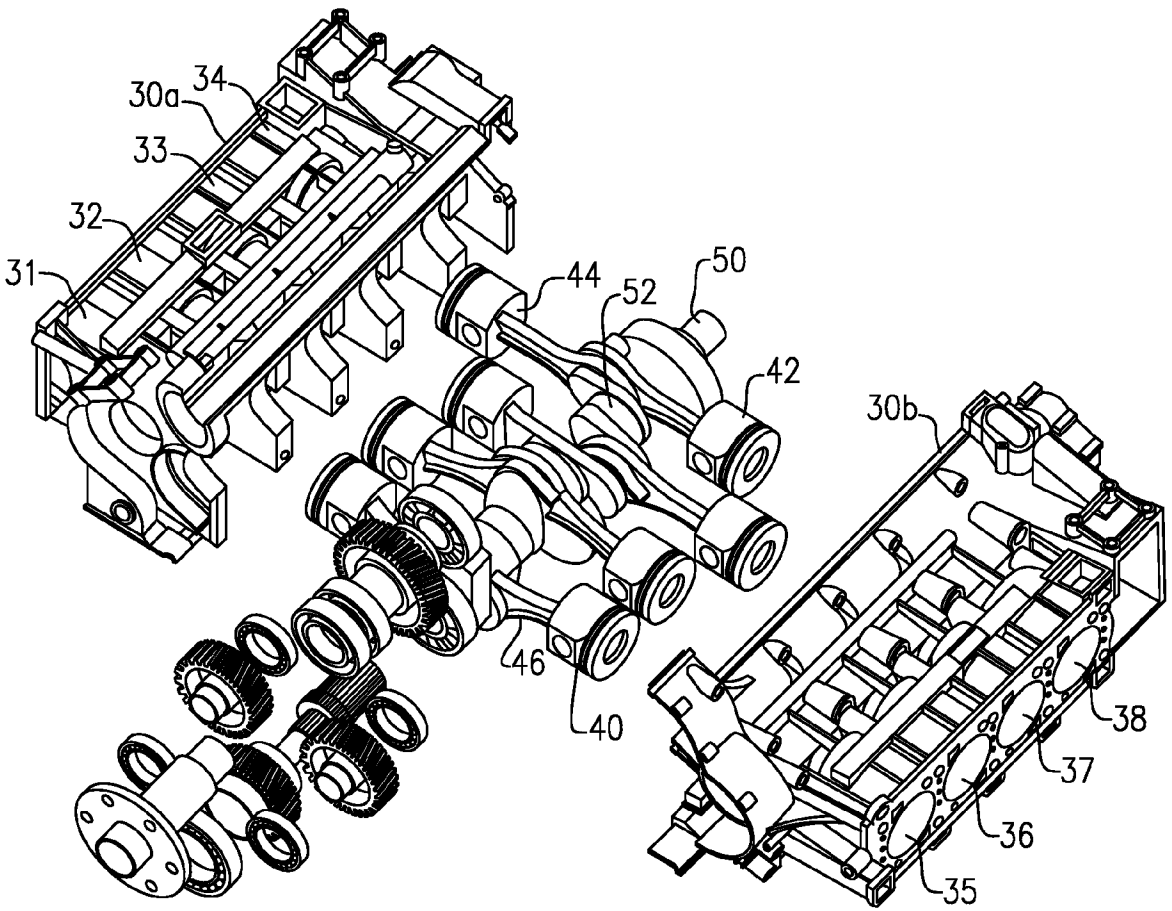
FIG. 15 is an exploded perspective view depicting certain features of the present invention.
Figure 16:
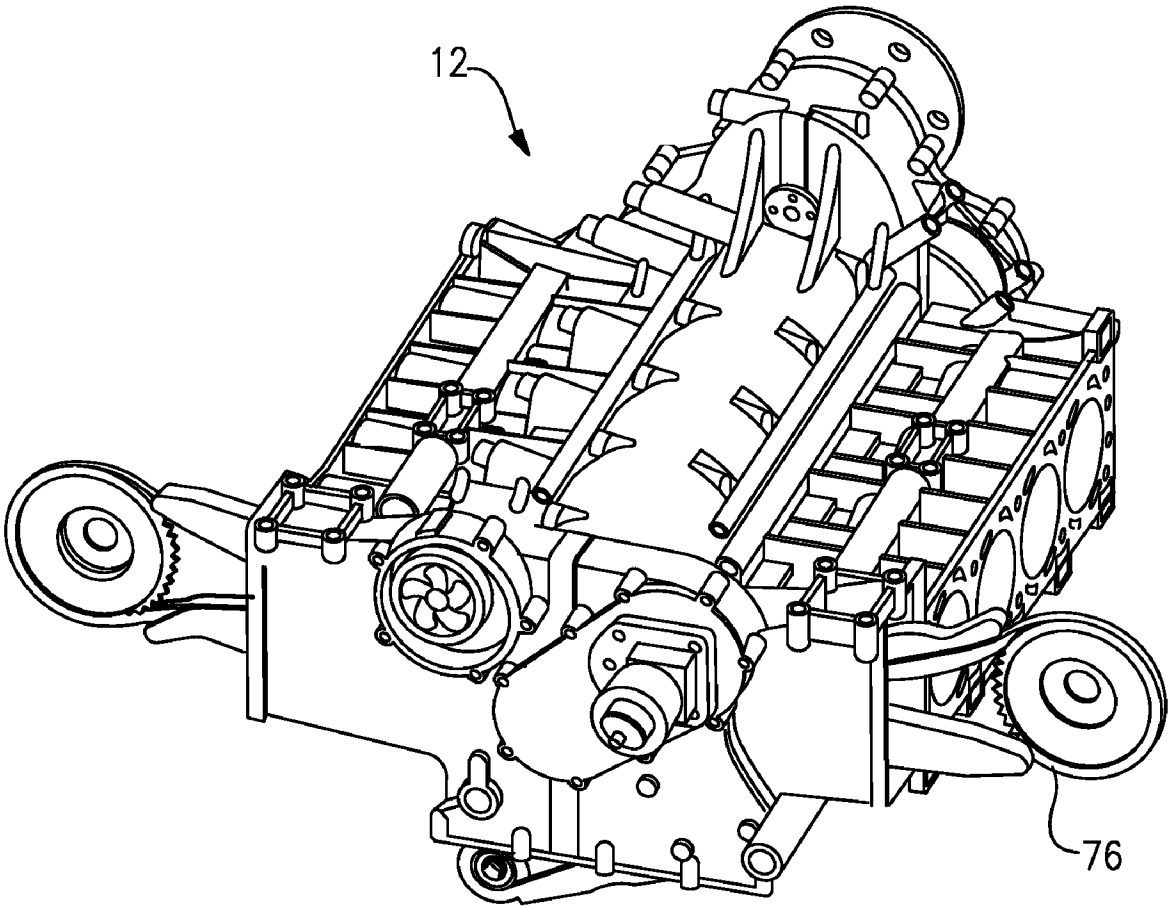
FIG. 16 is a perspective view of the engine block of the present invention.
Figure 18:
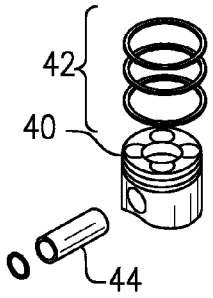
FIG. 18 is an exploded view of a piston and related components according to the present invention.

Referring generally to FIGS. 15-17, engine block 12 includes two halves, a first cylinder bank 30*a* and a second cylinder bank 30*b*. Cylinder bank 30*a* includes a first cylinder 31, a second cylinder 32, a third cylinder 33, and a fourth cylinder 34 (not shown). Cylinder bank 30*b* includes a fifth cylinder 35, a sixth cylinder 36, a seventh cylinder 37, and an eighth cylinder 38. In the present embodiment of the invention, engine 10 includes eight cylinders, however, horizontally opposed engines having for example four, six, ten, or twelve cylinders is within the contemplated scope of the invention. Each cylinder contains a piston 40, operably coupled to a first end of a connecting rod 46 by a wrist pin 44 shown in FIG. 18. Each piston 40 also includes one or more piston rings 42.

The crankshaft 50 (noted above) is also included in engine 10, and includes a plurality of bearing journal surfaces 52 that provide a means of securing crankshaft 50 in block 12. Crankshaft 50 further includes a plurality of connecting rod bearingjournals 54, 56, 58, and 60. As is known by one skilled in the art, the distance between the centerline of the crankshaft and the centerline of a connecting rod bearing journal is referred to as the "throw" of the crankshaft, and that term will be used alternatively herein with "connecting rod bearing journal." Each throw operably receives two connecting rods 46, one from each cylinder bank 30*a* and 30*b*. More particularly, the connecting rod from cylinder 31 and the connecting rod from cylinder 35 are operably coupled to throw 54. Similarly, the connecting rod from cylinder 32 and the connecting rod from cylinder 36 are operably coupled to throw 56. Similarly, the connecting rod from cylinder 33 and the connecting rod from cylinder 37 are operably coupled to throw 58. Similarly, the connecting rod from cylinder 34 and the connecting rod from cylinder 38 are operably coupled to throw 60. Throws 54 and 56 are adjacent, coplanar, and generally opposed. Similarly, throws 58 and 60 are adjacent, coplanar and generally opposed. Further, the plane defined by throws 54 and 56 is orthogonally disposed to the plane defined by throws 58 and 60. See the schematic of FIG. 14. A balance shaft 62 is operably coupled to crankshaft 50. Balance shaft 62 is preferably driven at engine speed.

According to a present embodiment of the invention, the firing order of the cylinders is as follows: 31, 37, 32, 38, 36, 34, 35, 33. (1, 7, 2, 8, 6, 4, 5, 3 in FIG. 14). A complete firing cycle of engine 10 comprises seven-hundred-twenty degrees of rotation of crankshaft 50, and therefore results in firing intervals occurring at every ninety degrees of rotation of crankshaft 50.

Figure 20:
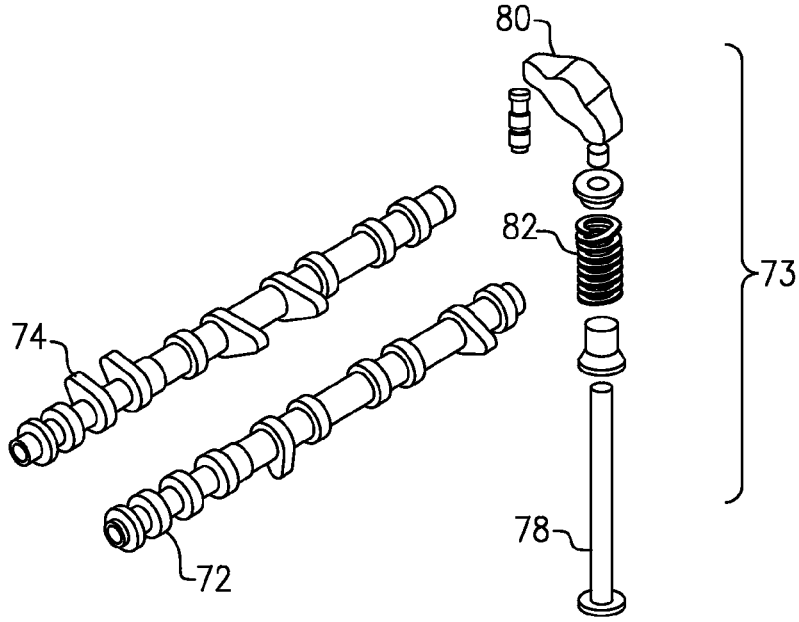
FIG. 20 is an exploded perspective view of camshafts and related components according to the present invention.
Figure 21:
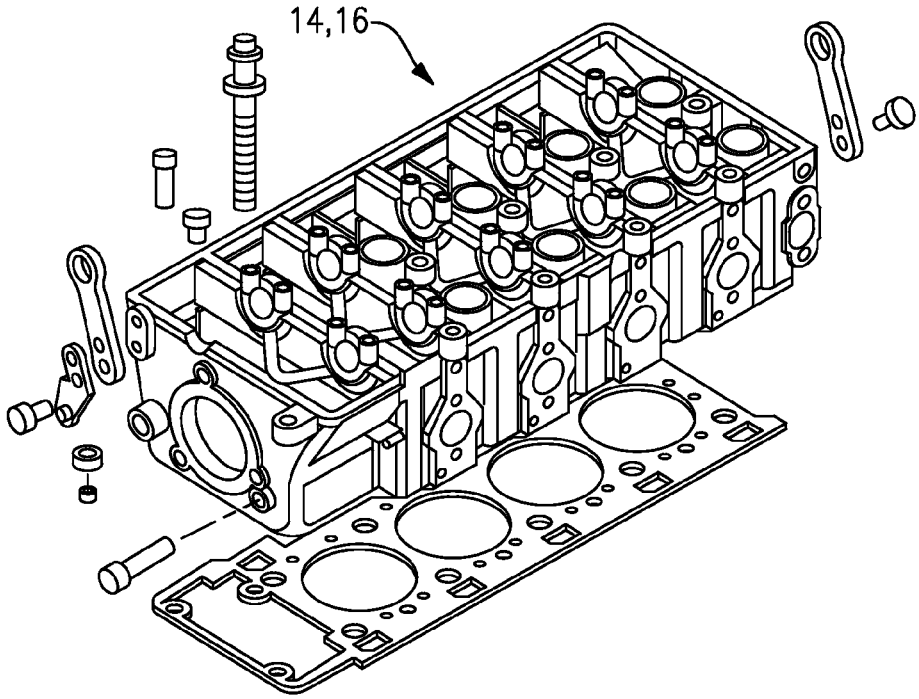
FIG. 21 is a perspective view of one embodiment of a cylinder head for the present invention.
Figure 26:
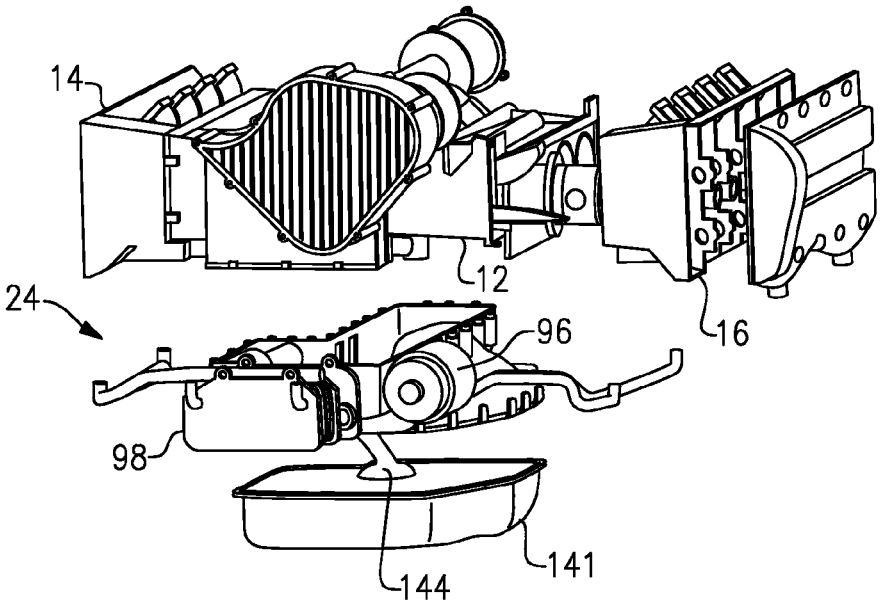
FIG. 26 is a partially exploded view of one embodiment of an oiling system for the present invention, with the engine block and cylinder heads shown for clarity.

Engine 10 also includes a first cylinder head 14 and a second cylinder head 16. FIG. 21 depicts a contemplated embodiment of a cylinder head. FIG. 26 depicts block 12 having a cylinder head 14 and a cylinder head 16 installed. Cylinder head 14 is coupled to cylinder bank 30*a*, and cylinder head 16 is coupled to cylinder bank 30*b*. Cylinder head 14 has a plurality of intake ports and a plurality of exhaust ports, and generally includes an intake camshaft 72 and an exhaust camshaft 74, operating at least one valve 78 through valve train 73 as shown in FIG. 20. Each camshaft is secured within cylinder head 14, and is coupled to a cam drive mechanism 76, which is operably coupled to crankshaft 50.

Figure 19:
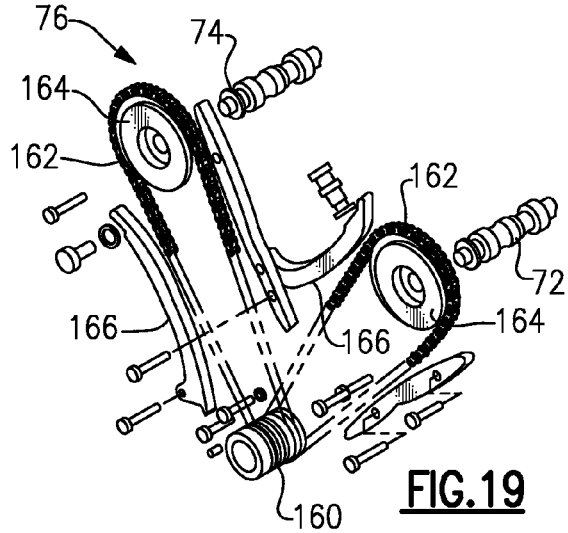
FIG. 19 is an exploded perspective view of one embodiment of a cam drive mechanism for the present invention
Figure 27:
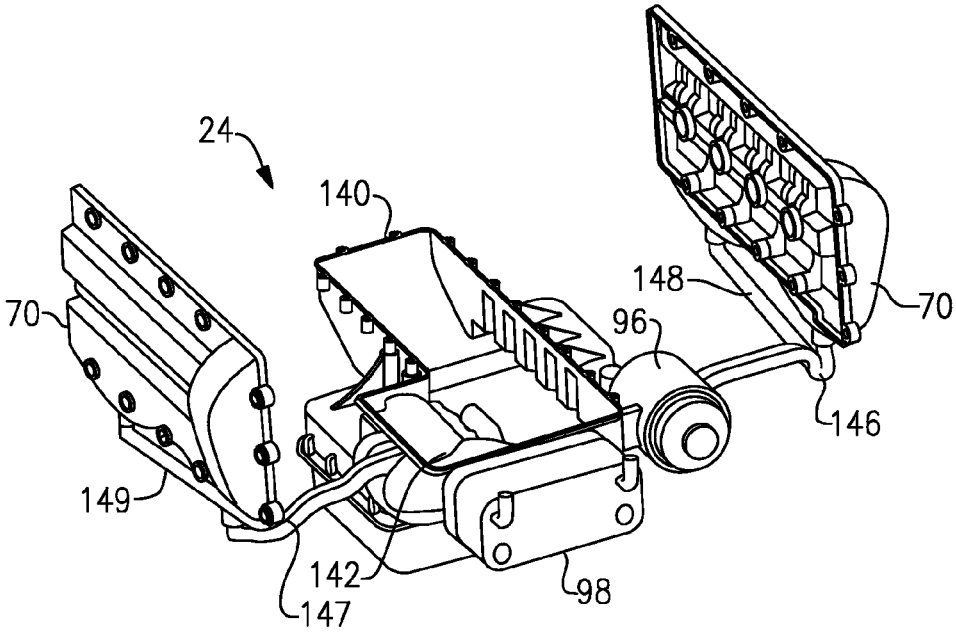
FIG. 27 is a perspective view of one embodiment of an oiling system for the present invention.
Figure 28:
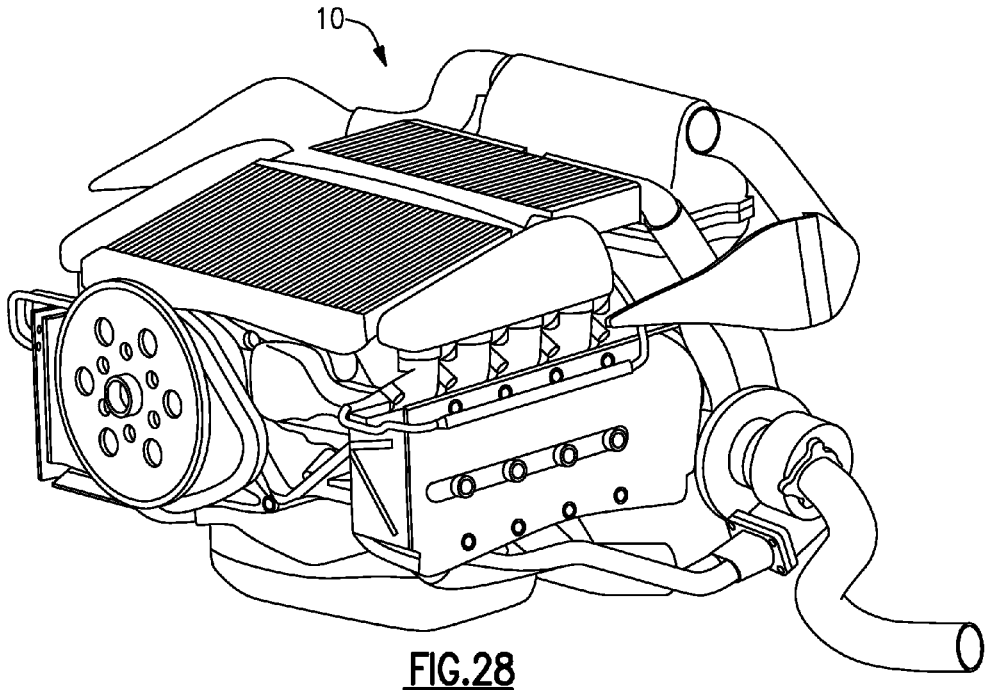
FIG. 28 is a perspective view of an embodiment of the present invention.

FIG. 19 depicts one embodiment of cam drive 76, and FIG. 16 depicts an embodiment of cam drive 76 installed in block 12. Intake camshaft 72 and exhaust camshaft 74 actuate a plurality of valves 78, rocker arms 80, and valve springs 82. Cylinder head 14 contains at least eight each of valves 78, rocker arms 80, and valve springs 82, as shown in FIG. 20. In the present embodiment of the invention, cylinder head 14 includes sixteen each of valves 78, rocker arms 80, and valve springs 82. Cam drive system includes gear 160, chain 162, sprocket 164 and tensioner 166. Cylinder head 14 further includes valve cover 70, as shown in FIG. 27. Similarly, cylinder head 16 has a plurality of intake ports and a plurality of exhaust ports, and generally includes an intake camshaft 72 and an exhaust camshaft 74. Each camshaft is secured within cylinder head 16, and is coupled to a cam drive mechanism 76, which is operably coupled to crankshaft 50. Intake camshaft 72 and exhaust camshaft 74 actuate a plurality of valves 78, rocker arms 80, and valve springs 82. Cylinder head 16 contains at least eight each of valves 78, rocker arms 80, and valve springs 82. In the present embodiment of the invention, cylinder head 16 includes sixteen each of valves 78, rocker arms 80, and valve springs 82. Cylinder head 16 further includes valve cover 70, as shown in FIG. 27.

Figure 22:
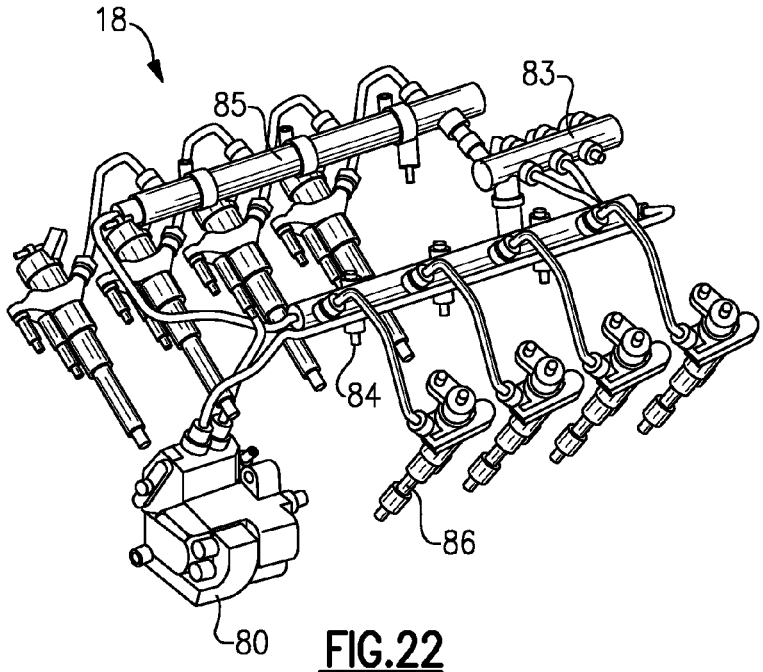
FIG. 22 is a perspective view of one embodiment of an injection system for the present invention.

Engine 10 further includes an injection system 18, as shown in FIG. 22. Injection system 18 comprises a high pressure fuel pump 80, a fuel pressure regulator 82, a first high pressure fuel rail 84, a second high pressure fuel rail 85, and a plurality of injectors 86. In the present embodiment of the invention, injection system 18 includes eight injectors 86.

A tremendous amount of time was spent to achieve effective vibration signature within the engine design concepts. This was done for several reasons which all add up to a comprehensive engine design which is optimized for use of structural materials and weight reduction. As detailed below, the design allowed the very lightweight aluminum cooling elements to be directly mounted, as well as giving additional service life to the engine mounted components and the aircraft structure.

In the diesel 10 engine, as in most engines, there are several circuits which must be cooled to ensure internal component reliability, such as the normal engine and oil coolers. The turbocharged diesel engine 10 requires an additional charge-air cooler (or intercooler) to achieve maximum performance. The function of this cooler is to increase charge density and thus air mass flow through the engine.

In this particular engine 10, the cooling requirements of the liquid elements of the engine are accomplished by an engine-mounted radiator. The oil is cooled by a water/oil element that ensures proper pre-warning of the oil in cold climates. Mounting on the engine is facilitated by the flat-vee configuration. It also allows the engine to be installed in traditional aircraft cowls without significant additional design work on the part of the aircraft company.

The flat-vee configuration of engine 10 allows the entire width of the engine bay to be pressurized and sealed to the twin cooler matrices. This minimizes resultant aircraft drag, which has a large effect on aircraft speed and fuel economy.

By not having to remote mount the glycol and water systems, the entire engine 10 installation remains lightweight. This is primarily due to the fact that water and oil lines are heavy, and do little to decrease the heat of the contained liquids. Also, this gives us a universal cooling strategy which can be used on all air-cooled aircraft designs. Hence, we make it easy for the manufacturer to make a retrofit of the engine assembly into existing aircraft.

Air-air charge air coolers share the pressure cowl with the engine cooler element. The two are in close proximity, and this feature allows for very compact packaging within constraints of the cowling. The charge air cooler installation provides for a unified engine cooling strategy.

Figure 23:
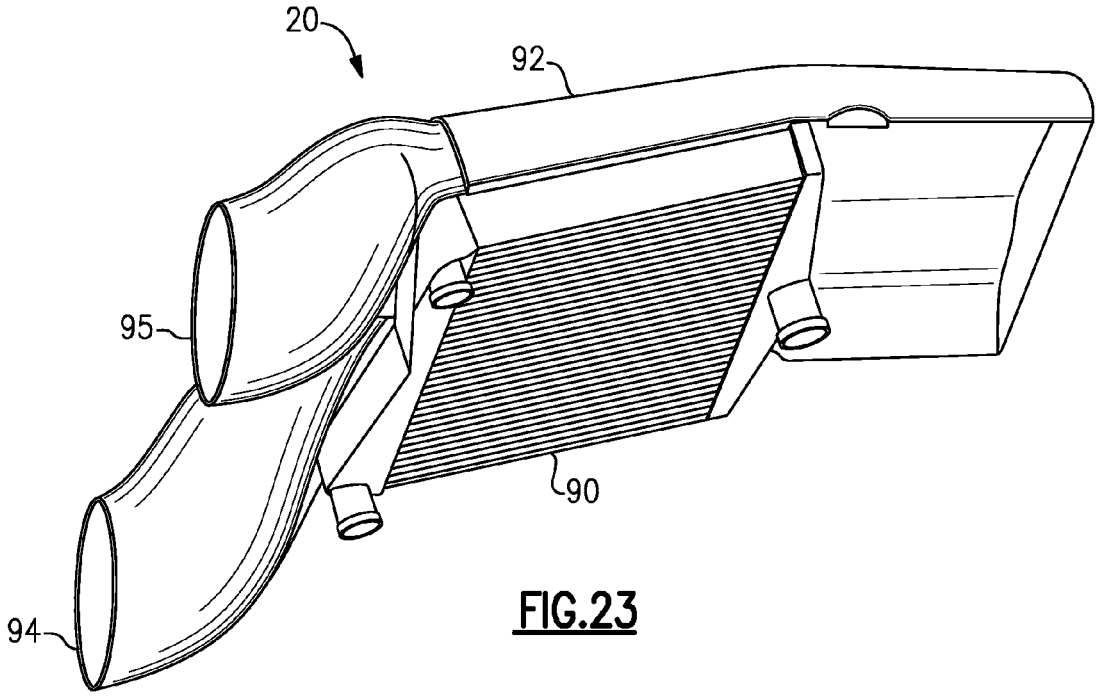
FIG. 23 is a perspective view of one embodiment of a cooling system for the present invention, with certain elements removed for clarity.

A cooling system 20 is also included in engine 10. Referring to FIG. 23, according to the present embodiment of the invention engine 10 is liquid-cooled, and cooling system 20 accordingly includes a radiator 90 mounted above engine 10. Radiator 90 is coupled to shroud 92, which has a first air inlet 94 and a second air inlet 95. Cooling system 20 further includes a water pump 96 (not shown), an oil-to-water heat exchanger 98 as shown in FIG., 27. Heat exchanger may be powered by engine fuel to sufficiently heat the engine prior to starting in cold ambient conditions.

Intercooler 100 is mounted above engine 10 and adjacent to radiator 90, and is also coupled to shroud 92. Air is drawn in through air inlets 94 and 95, and passes through radiator 90 and intercooler 100 by way of shroud 92, while water pump 96 circulates engine coolant through radiator 90. Oil-to-water heat exchanger 98 provides cooling to oiling system 24 (mentioned in detail below) by circulating engine coolant next to engine oil. In an alternative embodiment, it is contemplated that engine 10 is air cooled.

Figure 24:
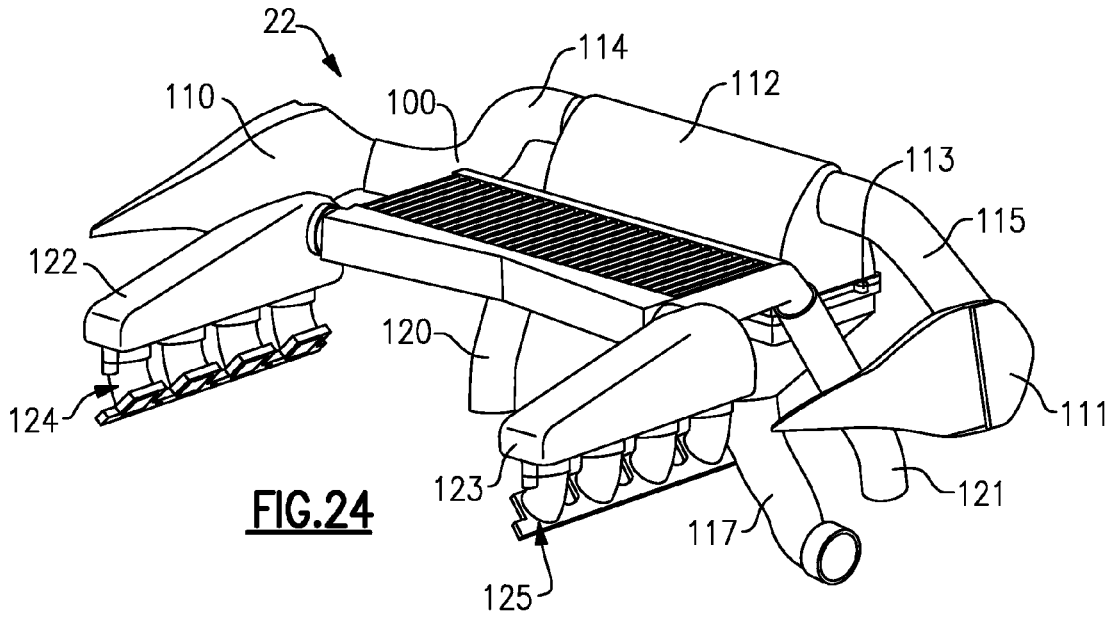
FIG. 24 is a perspective view of one embodiment of an intake system for the present invention.
Figure 25:
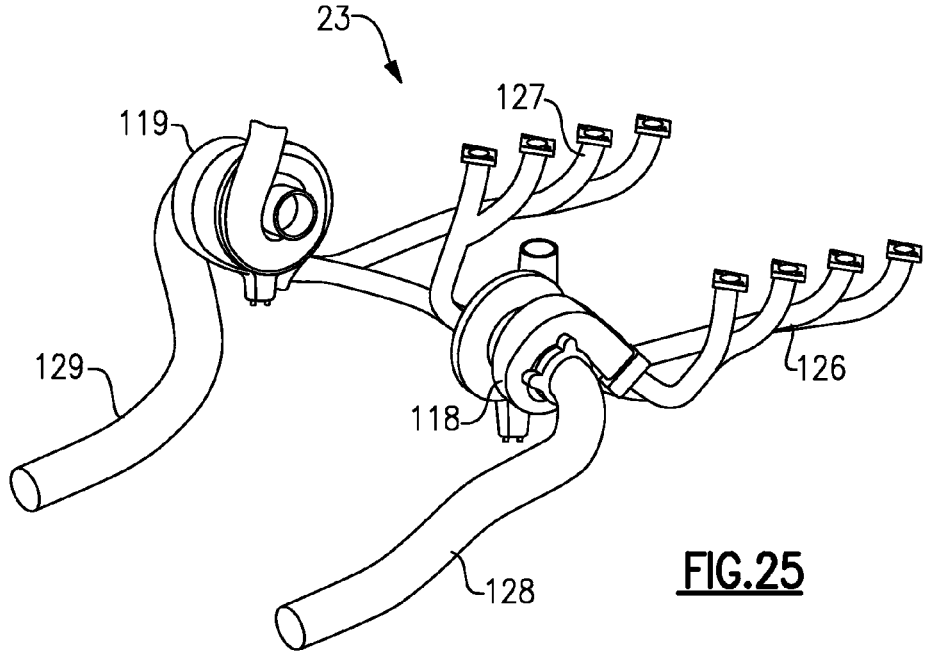
FIG. 25 is a perspective view of one embodiment of an exhaust system for the present invention.

Engine 10 also includes an intake system 22 and an exhaust system 23, as shown in FIGS. 24 and 25. Intake system 22 includes a first air inlet duct 110 and a second air inlet duct 111, which are respectively coupled to an airbox 112 by a first intake pipe 114 and a second intake pipe 115. Airbox 112 is preferably mounted above the engine, and may contain an air filter 113. Airbox 113 provides air through a first turbo inlet pipe 116 (not shown) to a first turbocharger 118, and through a second turbo inlet pipe 117 to a second turbocharger 119. Turbochargers 118 and 119 are preferably mounted proximate to cylinder heads 14 and 16, respectively. Turbochargers 118 and 119 are operably coupled to intercooler 100, by a first intercooler pipe 120 and a second intercooler pipe 121. Intercooler 100 is coupled to a first intake plenum 122 and a second intake plenum 123. Intake manifold 124 connects plenum 122 to the intake ports of cylinder head 14, and intake manifold 125 similarly connects plenum 123 to the intake ports of cylinder head 16. In exhaust system 23, a first end of exhaust manifold 126 is coupled to the exhaust ports of cylinder head 14, while a second end of manifold 126 is coupled to turbocharger 118. Similarly, a first end of exhaust manifold 127 is coupled to the exhaust ports of cylinder head 16, while a second end of manifold 127 is coupled to turbocharger 119. Turbochargers 118 and 119 further include respective exhaust pipes 128 and 129.

Referring to FIGS. 26 and 27, an oiling system 24 is also included in engine 10. Oiling system 24 comprises an upper oil pan section 140 and a lower oil pan section 141. Sections 140 and 141 are coupled to one another, and upper oil pan section 140 is coupled to engine 10. Oil pump 142 draws oil from lower pan 140 through an oil pickup 144. Pump 142 supplies oil to oil-to-water heat exchanger 98. Oiling system 24 supplies oil to cylinder bank 30*a* by pumping oil through oil feed line 146 into valve cover 70. An oil return line 148 is also provided for cylinder bank 30*a*. Similarly, cylinder bank 30*b* is supplied oil by pumping oil through oil feed line 147 into valve cover 71. Oil return line 149 is provided for cylinder bank 30*b*.

Figure 29:
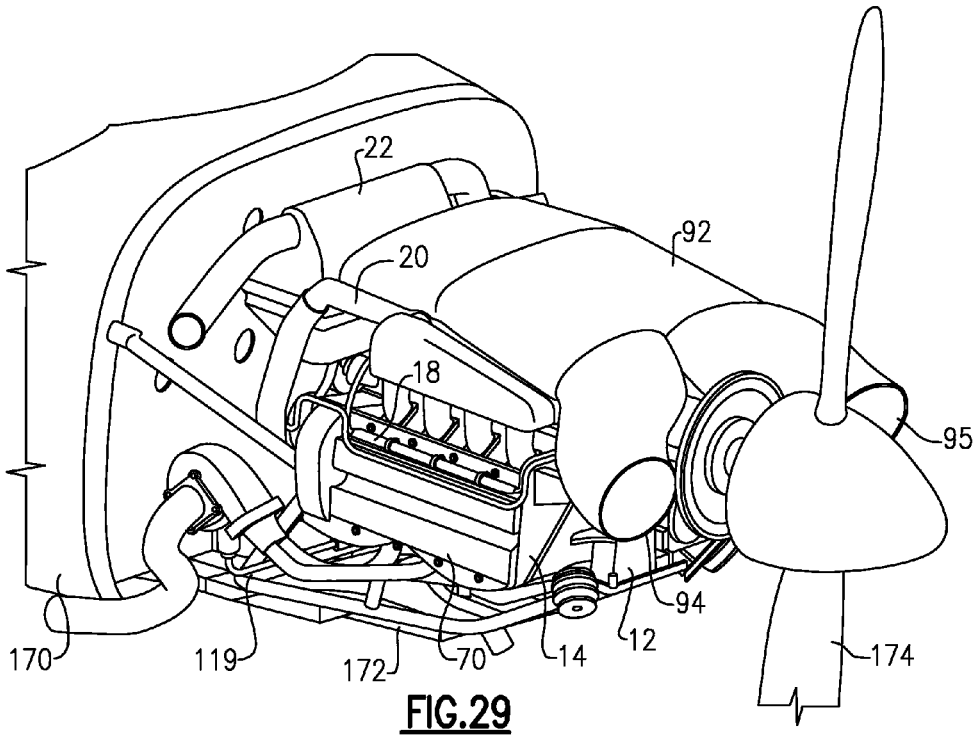
FIG. 29 is a perspective view of an embodiment of the present invention installed in an aircraft.

FIG. 29 depicts the integrated engine 10 mounted to aircraft nacelle 170 and frame 172 and having propeller 174.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

What is claimed is:

1. An integrated engine, comprising:

a unitary structure including at least the components of;

two banks of cylinders in a flat, opposed cylinder arrangement;

a crankshaft having four throws, a first pair of throws, comprising two of the four throws, the two throws being adjacent and coplanar and a plane of the first pair being orthogonally disposed with respect to a plane of a second pair of throws, the second pair of throws comprising the remaining two of the four throws, the two throws of the second pair being adjacent and coplanar, wherein the cylinders are numbered 1, 2, 3, and 4 in a first bank and 5, 6, 7, and 8 in a second bank and a firing order by cylinder is 1, 7, 2, 8, 6, 4, 5, and 3;

air charge compressor and air charge cooler assembly;

liquid engine cooler assembly; and liquid oil cooler assembly.

2. The engine of claim 1, the air charge compressor being a pair of turbochargers, a respective turbocharger being powered by the exhaust from a respective bank of cylinders.

3. The engine of claim 1, a piston being associated with each cylinder and being numbered correspondingly, pistons 1 and 5 being operably coupled to a first throw, pistons 2 and 6 being operably coupled to a second throw; pistons 3 and 7 being operably coupled to a third throw, and pistons 4 and 8 operably coupled to a fourth throw.

4. The engine of claim 1 wherein the firing intervals are eight by ninety degrees.

5. The engine of claim 1 including a first order moment balance shaft having a balance weight supported on each of opposing end portions of the balance shaft.

6. The engine of claim 5, the balance shaft being rotationally driven at engine speed.

7. The engine claim 1 being a compression combustion engine.

8. An integrated engine, comprising:

a unitary structure including at least the components of;

two banks of cylinders in a flat, opposed cylinder arrangement;

air charge compressor and air charge cooler assembly;

liquid engine cooler assembly;

liquid oil cooler assembly; and the air charge compressor being a pair of turbochargers, a respective turbocharger being powered by the exhaust from a respective bank of cylinders, wherein the air charge cooler is an intercooler arranged between an air box and first and second intake plenums that are respectively in communication with first and second banks of the two banks of cylinders.

9. The engine of claim 8 comprising a radiator arranged forward of the intercooler, and a shroud arranged over the radiator and intercooler.

10. The engine of claim 9, wherein the shroud includes first and second air inlets arranged on either side of a rotational axis of a propeller driven by the engine.

11. The engine according to claim 9, wherein the radiator and intercooler are arranged in a generally horizontal plane that is generally parallel to a rotational axis of a crankshaft.

* * * * *